United States Patent [19]

Tischer

[11] Patent Number: 4,888,221

[45] Date of Patent: Dec. 19, 1989

[54] MONEY TREE

[76] Inventor: Martine Tischer, 23555 N. Highway 45, Mundelein, Ill. 60060

[21] Appl. No.: 225,889

[22] Filed: Jul. 29, 1988

Related U.S. Application Data

[63] Continuation-in-part of Ser. No. 83,224, Aug. 10, 1987, Pat. No. 4,776,511.

[51] Int. Cl.[4] ..... A41G 1/00

[52] U.S. Cl. ..... 428/18; 156/61; 428/26; 428/181

[58] Field of Search ..... 428/18, 19, 20, 26, 428/17, 181; 156/61, 226, 227; 229/87 R, 125.38

[56] References Cited

U.S. PATENT DOCUMENTS

| | | | |
|---|---|---|---|
| D. 101,788 | 11/1936 | Miltenberger | D11/118 |
| D. 225,119 | 11/1972 | Tartar | D11/118 X |
| 2,097,513 | 11/1937 | Casey | 428/7 X |
| 2,335,219 | 11/1943 | Abramson | 428/10 X |
| 2,503,359 | 4/1950 | Smith | 428/18 X |
| 3,565,736 | 2/1971 | Jason | 428/26 |
| 3,581,419 | 6/1971 | McCracken | 428/18 X |
| 3,844,873 | 10/1974 | Dalske | 428/18 |
| 4,224,364 | 9/1980 | Hunt | 428/11 |
| 4,321,291 | 3/1982 | Brownell | 428/181 X |
| 4,559,583 | 12/1985 | Ku | 40/124.2 X |
| 4,776,511 | 10/1988 | Tischer | 229/87 R |

*Primary Examiner*—Henry F. Epstein
*Attorney, Agent, or Firm*—Thomas R. Vigil

[57] ABSTRACT

The method of forming a money tree or bush comprises the steps of providing at least two rod-like members; providing at least two bills of paper-like negotiable currency; accordion pleating each bill along the length thereof; pinching each pleated bill in the middle area of the accordion; securing each bill at the pinch to a rod-like member; and fanning out the accordion pleated sections of each pleated bill around the place of securement to one of the rod-like members to form a structure looking like an imitation green and white leaf or flower. The money tree or bush formed thereby includes at least two rod-like members and at least two fanned out pleated bills formed in the manner described.

8 Claims, 2 Drawing Sheets

MONEY TREE

CROSS-REFERENCE TO RELATED APPLICATIONS

This application is a continuation-in-part of U.S. application Ser. No. 083,224 now U.S. Pat. No. 4,776,511 for: PACKAGE filed on Aug. 10, 1987 by MARTINE TISCHER.

BACKGROUND OF THE INVENTION

1. Field of the Invention

The present invention relates to a gift item in the form of a branch with a leaf or flower formed from a folded or pleated bill of negotiable currency mounted thereon. More specifically, the present invention relates to a money tree having leaves made of decoratively folded or pleated paper-like bills of negotiable currency.

2. Description of the Prior Art

Heretofore it has been proposed to create ornamental tree designs from various materials and in various shapes.

For example, U.S. Des. Pat. No. 101,788 discloses an artificial tree ornament including a base, a trunk and fan shaped leaves suspended outwardly and downwardly from the trunk.

U.S. Des. Pat. No. 225,119 discloses an ornamental design for a money tree bank, the bank having the shape of a pine tree, having a coin receiving slot in the body of the tree and having a removable base plate for emptying the bank.

The Smith U.S. Pat. No. 2,503,359 discloses an ornamental tree shaped display device including a base supporting a trunk having a plurality of large, substantially flat simulated leaves positioned on and supported by the trunk. The leaves are adapted to support and have fastened thereto greeting cards and the like. The tree may be disassembled for compact storage thereof.

The McCracken U.S. Pat. No. 3,581,419 discloses a door hung, pine tree shaped structure for use in displaying Christmas cards mounted thereon.

The Dalske et al U.S. Pat. No. 3,844,873 discloses a Christmas tree construction comprising a plurality of wire limbs having an accordion folded cloth net member threaded onto the wire and spirally wound therearound to provide cylindrical limbs which are mountable onto a central support structure.

As will be described in greater detail hereinafter, the money branch or tree of the present invention differs from ornamental trees previously proposed by providing a branch or tree structure having the appearance of a tree or flower and including a branch framework, to which are attached paper-like bills of negotiable currency, such as dollar bills, which are folded or pleated transversely into strip portions much like an accordion or fan and then held to various ones of the branches of the framework and allowed to fan out so as to give the appearance of a leaf or of a flower.

SUMMARY OF THE INVENTION

According to the invention there is provided a money tree or bush comprising at least two narrow elongate members, at least two paper-like bills of negotiable currency each pleated into an accordion shape along the length thereof, each bill being separately and individually attached to one of said elongate members forming a branch, and each currency bill being attached to said branch by an attachment member positioned at a point of attachment intermediate pleated and edges of the bill, dividing said bill into substantially identical accordion pleated halves, each of which is fanned out about the point of attachment to form a semi circular structure in the form of an imitation leaf or flower.

Further according to the invention there is provided a method of forming a money tree or bush comprising the steps of: providing at least two rod-like members; providing at least two bills of paper-like negotiable currency;

accordion pleating each bill along the length thereof;

pinching each pleated bill in the middle area of the accordion;

securing each bill to one rod-like member; and fanning out the accordion pleated sections of each bill around the point of securement to form a structure looking like an imitation leaf or flower.

DESCRIPTION OF THE PREFERRED EMBODIMENT

Figure 1:
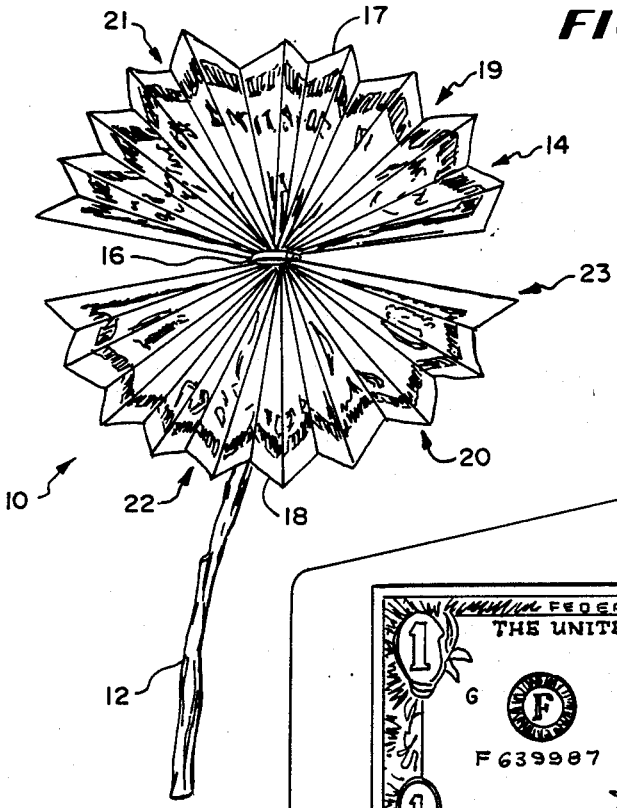
FIG. 1 is a perspective view of a money flower or money tree branch made in accordance with the teachings of the present invention.

Referring now to the drawings in greater detail, there is illustrated in FIG. 1 a money branch 10 constructed according to the teachings of the present invention. The money branch 10 is used with another branch or trunk to form a tree or bush which can be used by itself or inserted as a collage or corsage on a package as shown in U.S. Pat. No. 4,776,511 from which this application claims priority and a disclosure of which is incorporated herein by reference.

As shown, the branch 10 includes an elongate rod-like member 12 which, in one preferred embodiment, is a wooden branch from a bush and a paper-like bill of negotiable currency 14 which has been pleated into an accordion shape along the length of the bill 14 and is attached to the member 12 by a rubber band 16. The rubber band 16 is positioned intermediate pleated end edges 17 and 18 of the bill 14 to provide substantially identical halves 19 and 20 of the bill 14 which may be fanned out to form flower or leaf half sections 21 and 22 which define a flower like or leaf like structure 23.

Figure 2:
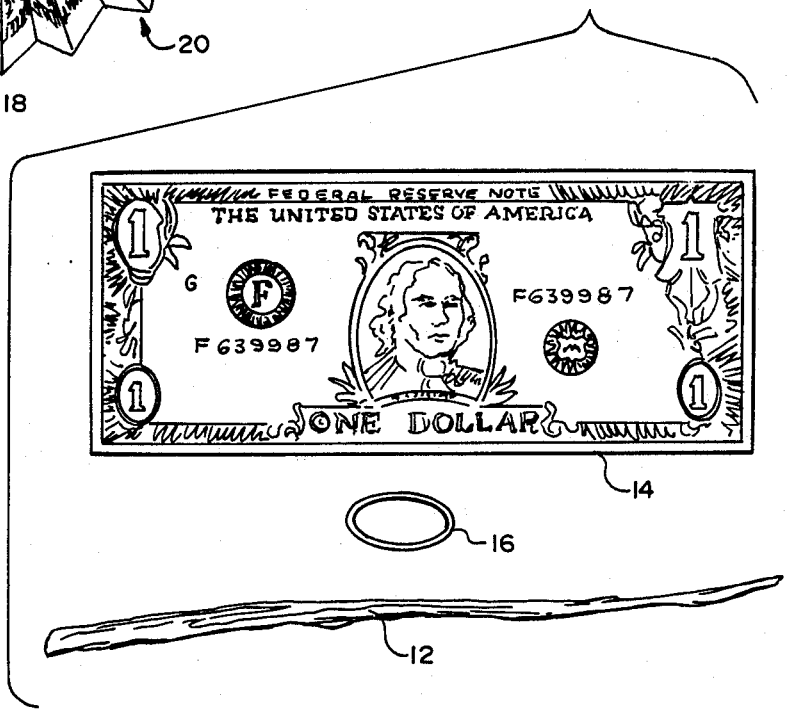
FIG. 2 is an exploded perspective view of the simple components of the money flower or money tree branch.

FIG. 2 shows the three simple components required to form the money branch 10, namely the rod-like member 12, the paper-like bill of negotiable currency 14 and the rubber band 16 for securing the bill 14 to the rod-like member 12.

Figure 3:
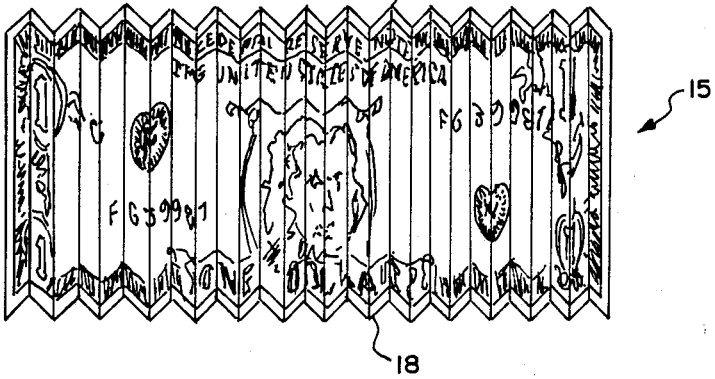
FIG. 3 is a plan view of a lengthwise accordion pleated paper-like bill of negotiable currency.

In FIG. 3, the simple lengthwise accordion pleating of the bill of currency 14 into a pleated bill 15 is illustrated.

Figure 4:
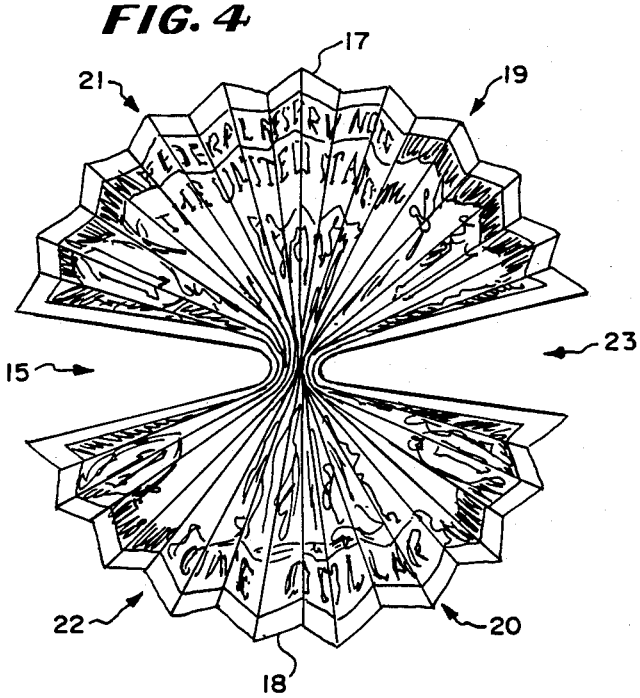
FIG. 4 is a plan view of the pleated bill showing pinching in a middle area thereof for forming a flower or leaf from the accordion pleated bill.

In FIG. 4, is shown the pinching inward, at a point approximately in the center of the pleated bill 15, intermediate the end edges 17 and 18 of the accordion pleated bill 15 along the width of the pleated bill 15 to create identical halves 19 and 20 is shown, with the halves 19 and 20 being fanned outwardly, each producing flower or leaf half sections 21 and 22 for creating the flower or leaf 23.

Figure 5:
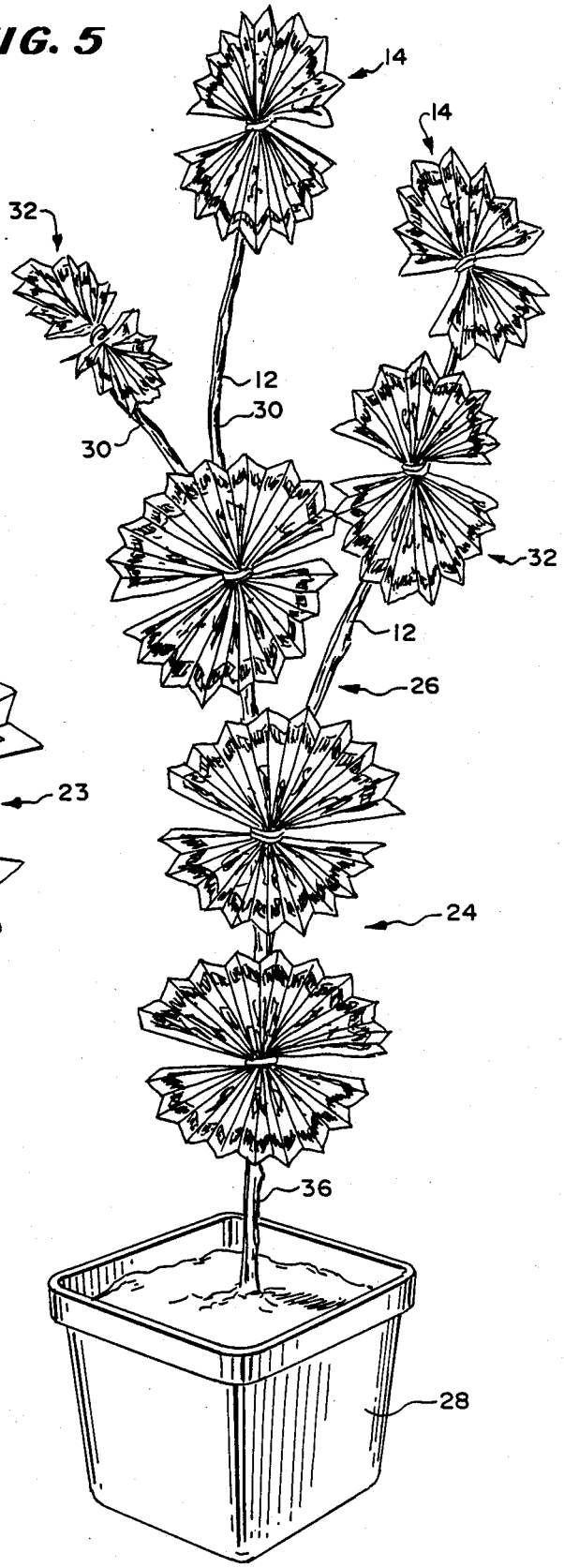
FIG. 5 is a perspective view of a money tree made in accordance with the teachings of the present invention.

In FIG. 5, a money tree 24 is illustrated. Here, a plurality of rod-like members 12 are utilized to formed the branched tree 24. Alternatively, a branched limb 26, as found in nature, may be used. The tree 24 is maintained vertical by a base 28. In the tree 24, multiple accordion pleated bills 15 are attached along branches 30 of the limb 26 to create a tree 24 having leaves or flowers 32 made of negotiable paper currency.

As shown, the money leaves or flowers 32 may be connected to the limb 26 along the branches 30 thereof, may be placed at branch intersections (hidden from view), and may be placed along a trunk forming portion 36 of the limb 26.

The money branch 10 or money tree 24 of the present invention may be given as a gift in itself or, alternatively, as disclosed in U.S. application Ser. No. 083,224, the money branch 10 may be used to decorate a gift package, providing additional value to the value of the gift within the package.

The money branch 10 or money tree 24 may be kept intact as a memento of a particular occasion, or may be broken down, with the negotiable currency bills 14 being saved or spent, and the remainder being discarded or used to display items other than currency bills 14 thereon.

From the foregoing description, it will be apparent that modifications can be made to the money tree and method for making same of the present invention without departing from the teachings of the invention. Accordingly, the scope of the invention is only to be limited as necessitated by the accompanying claims.

I claim:

1. A money tree or bush comprising at least two narrow elongate members, at least two paper-like bills of negotiable currency each pleated into an accordion shape along the length thereof, each bill being separately and individually attached to one of said elongate members forming a branch, and each currency bill being attached to said branch by an attachment member positioned at a point of attachment intermediate pleated end edges of the bill, dividing said bill into substantially identical accordion pleated havles, each of which is fanned out about the point of attachment to form a semi circular structure in the form of an imitation leaf or flower.

2. The branch of claim 1 wherein said elongate member is a linear tree branch.

3. The branch of claim 1 wherein said elongate member is a linear piece of coated wire.

4. The branch of claim 1 wherein said attachment member comprises an elastic band.

5. The branch of claim 1 wherein said attachment member comprises a piece of string.

6. The branch of claim 1 wherein said attachment member comprises a piece of metal wire.

7. The money tree or bush of claim 1 comprising a center elongate member forming a trunk and two or more elongate members forming branches and being connected to said trunk and a plurality of folded and then fanned out bills each separately attached to one of said branches.

8. A method of forming a money tree or bush comprising the steps of:

providing at least two rod-like members;

providing at least two bills of paper-like negotiable currency;

accordion pleating each bill along the length thereof;

pinching each pleated bill in the middle area of the accordion;

securing each bill to one rod-like member; and fanning out the accordion pleated sections of each bill around the point of securement to form a structure looking like an imitation leaf or flower.

* * * * *